US005269225A

United States Patent [19]

Bosshart et al.

[11] Patent Number: 5,269,225

[45] Date of Patent: Dec. 14, 1993

[54] APPARATUS AND METHOD FOR DISTRIBUTING AND APPLYING RAIL CLIPS AND INSULATORS

[75] Inventors: John H. Bosshart, Overland Park, Kans.; Gary F. Lux, St. Joseph, Mo.; Terrance Cunningham, St. Joseph, Mo.; Ivan E. Bounds, St. Joseph, Mo.; George A. Hinsley; Doyle S. Russell, both of Knoxville, Tenn.

[73] Assignee: Burlington Northern Railroad, Fort Worth, Tex.

[21] Appl. No.: 52,823

[22] Filed: Apr. 23, 1993

Related U.S. Application Data

[63] Continuation of Ser. No. 670,989, Mar. 18, 1991, abandoned.

[51] Int. Cl.[5] ..... E01B 29/24

[52] U.S. Cl. ..... 104/2; 104/17.2; 104/307

[58] Field of Search ..... 104/17.2, 7.2, 2, 307

[56] References Cited

U.S. PATENT DOCUMENTS

| | | | |
|---|---|---|---|
| 3,117,530 | 1/1964 | Miller | 104/17.2 |
| 3,680,486 | 8/1972 | Plasser et al. | 104/307 |
| 3,766,860 | 10/1973 | McIlrath | 104/17.2 |
| 3,841,221 | 10/1974 | Dieringer et al. | 104/17.2 |
| 4,319,392 | 3/1982 | Cutts | 104/17.2 X |
| 4,494,463 | 1/1985 | Young et al. | 104/307 |
| 4,669,387 | 6/1987 | Casarini et al. | 104/2 X |
| 5,003,888 | 4/1991 | Martin | 104/17.2 |

FOREIGN PATENT DOCUMENTS

| | | | |
|---|---|---|---|
| 2348014 | 5/1974 | Fed. Rep. of Germany | 104/7.2 |
| 1540868 | 2/1979 | United Kingdom | 104/307 |
| 2102863 | 2/1983 | United Kingdom | 104/17.2 |

*Primary Examiner*—Robert J. Oberleitner
*Assistant Examiner*—Kevin D. Rutherford
*Attorney, Agent, or Firm*—Merchant, Gould, Smith, Edell, Welter & Schmidt

[57] ABSTRACT

An automatic rail securing device (10) mounted on a railroad car (12) upon which a device (20) for manipulating the track is mounted, as well as work positions to permit the placement of insulators (40) on the railroad ties (34) as well as clips (5). A clip securing apparatus (66) is slidably mounted to car 12 by means of wheels (15, 17) and struts (23, 25). The apparatus (66) includes two satellite stations (70, 72) which include a pair of compression members (74, 76) which automatically engage the clip (5) and secure it in a final position adjacent to the rail (32).

9 Claims, 7 Drawing Sheets

FIG. 8
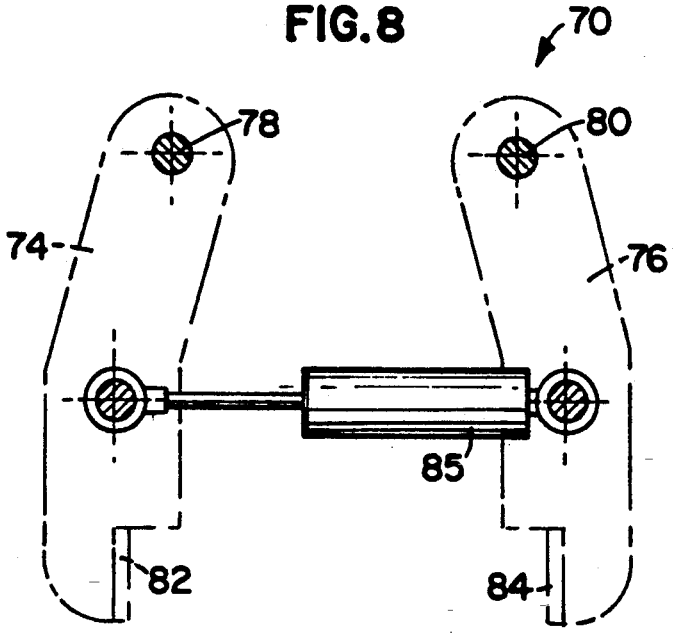
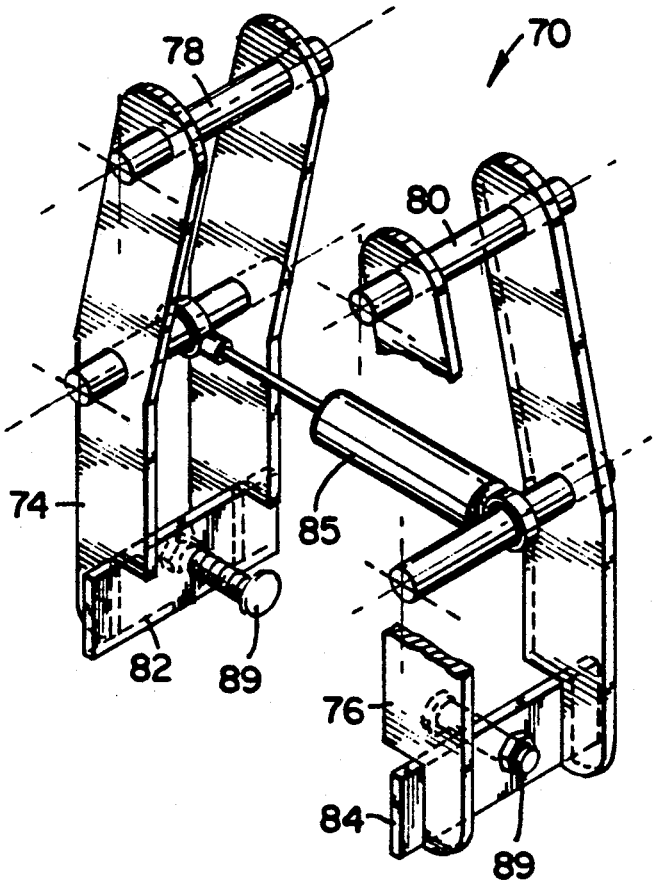
FIG. 9

APPARATUS AND METHOD FOR DISTRIBUTING AND APPLYING RAIL CLIPS AND INSULATORS

This is a continuation of application Ser. No. 07/670,989, filed Mar. 18, 1991, which was abandoned upon the filing hereof.

FIELD OF THE INVENTION

This invention relates to an apparatus and method for placing and attaching rail insulators, and more particularly, to an apparatus and method for attaching clips and insulators to secure the rail to the railroad tie.

BACKGROUND OF THE INVENTION

The need for securing railroad rails to rail ties has existed for centuries. The process is very labor intensive and must be done accurately so that the attachment is secure. Currently, a railroad car is used to carry and distribute the rail clips and insulators to the ties for application. Manual labor is utilized to unload and place four insulators and clips per tie. At that point, another work force is needed to manually place the insulators and clips for a subsequent securing operation. Following this, a piece of work equipment moves along the tracks and the clips are squeezed into the concrete tie shoulder. This method is very labor intensive and also difficult for the workers.

Therefore, it is desirable to have an apparatus and method for placing the clips and insulators where the accuracy and rate of work may be increased and the comfort to the worker is satisfactory. The present invention addresses the problems associated with the prior method of placing clips and insulators.

SUMMARY OF THE INVENTION

The present invention is an apparatus and method for distributing and applying rail clips and insulators to ties and track. The apparatus includes a source to power the car down the track, a rail manipulator to aid in placing insulators adjacent to the tie and rail, supply compartments for the insulators and clips, loading areas for workers to place the clips and insulators, and the clip applicator.

In a preferred embodiment, the car is equipped with a crane to load the compartments with clips and insulators which are placed so that the workers have easy access to place the clips on the ties and rails.

Yet another advantage of the present invention is the applicator. The applicator includes a framework which supports two pairs of squeezing members. The applicator moves with the car and yet moves independently to stop momentarily to apply the clips of each tie as the car moves continuously down the track.

The present invention may be operated efficiently with four workers positioned in the car to provide a smooth application of clips and insulators on a continuous basis adjacent to the rails making up the track.

For a better understanding of the invention, and of the advantages obtained by its use, reference should be made to the drawings and accompanying descriptive matter, in which there is illustrated and described a preferred embodiment of the invention.

BRIEF DESCRIPTION OF THE DRAWINGS

In the drawings, which form a part of the specification and are to be read therewith, optimum embodiments of the invention are shown, and, in the various views, like numerals are employed to indicate like parts:

FIG. 8 is a side elevation depicting a portion of the clip applicator constructed in accordance with the principles of the present invention;

FIG. 9 is a perspective view of a portion of a clip applicator built in accordance with the principles of the present invention.

DETAILED DESCRIPTION OF THE PREFERRED EMBODIMENT

Figure 1:
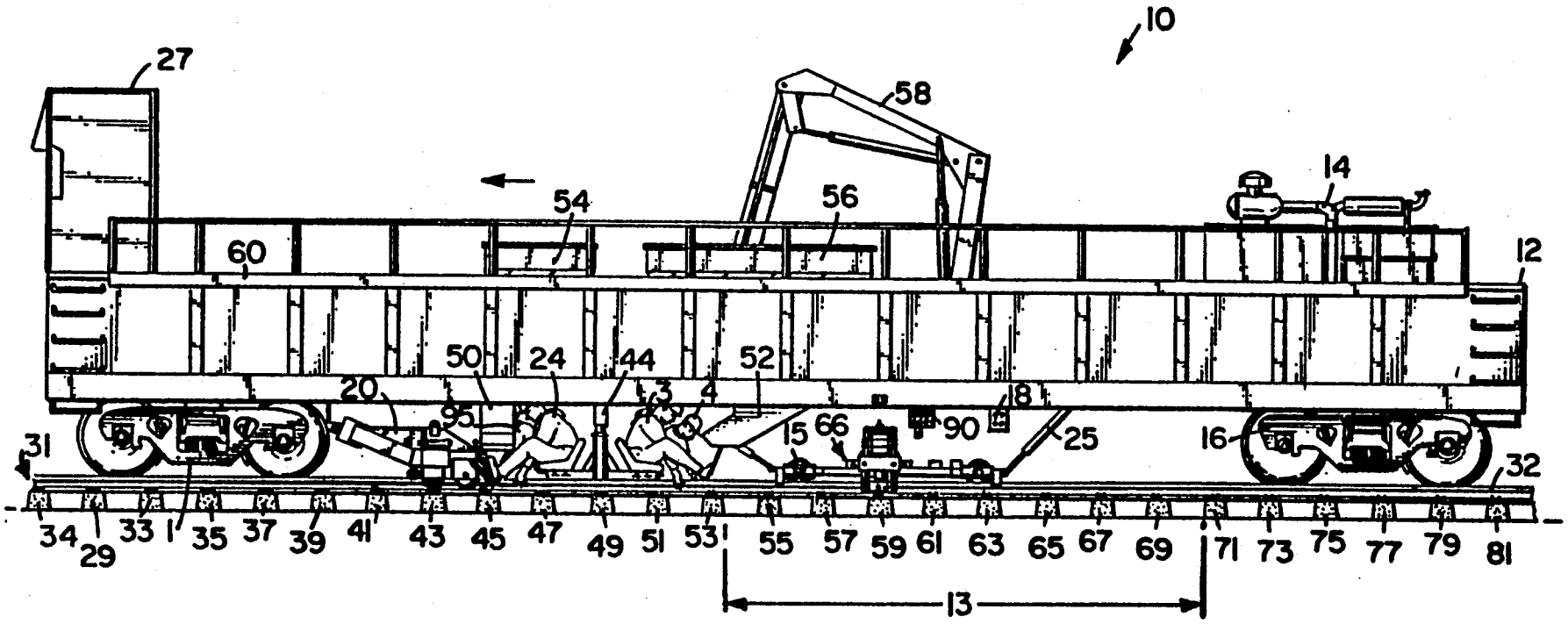
FIG. 1 is a side elevation view of the applicator car of the present invention.

Referring to FIG. 1, an applicator car 10 is shown according to the present invention. A rail car 12 is equipped with an engine 14 and power truck 16 to power the car. The applicator car 10 is self-powered. A diesel engine 14 is utilized with the invention. The engine 14 powers hydraulic and electrical systems which manipulate and power the other aspects of the invention. Power truck 16 is driven by the engine 14 to move the car along the rails. In a preferred embodiment, the power truck 16 is a two speed unit. The power trucks 16 and idler truck 1 include axles, wheels, bolsters, springs, center castings, and other known parts to carry the car and move it for use. A pump (not shown) powered by the engine 14 moves the truck 16 at either a high traveling speed or a low speed suitable for propelling the car prior to entering the work mode. In a preferred embodiment, the low speed is approximately two miles per hour and the traveling or high speed is approximately thirty-five miles per hour. Yet a further advantage of the invention is that it can be taken out of gear and then pulled by a regular train at higher speeds to move from work area to work area.

A cab 27 is used to control car 12 in the travel mode only, and contains a tachometer, engine temperature gauge, voltage meter, air pressure gauge, throttle, brake and on/off control (not shown).

Speed controls 18 are utilized to control the hydraulic flow to the pump and to put the car 10 in the work mode. In the work mode, the car 10 is moved at approximately ¼ mile per hour (24 feet per minute) so that the workers 24, 95, 3 and 4 may arrange the work pieces 5, 40 adjacent to rails 32 such that they may be clipped to the ties 29, 33, 34, 35, 37, 39, 41, 43, 45, 47, 49, 51, 53, 55, 57, 59, 61, 63, 65, 67, 69, 71, 73, 75, 77, 79, 81 at an acceptable speed. A speed of ¼ mile per hour allows eight to twelve ties per minute (twenty-four feet per minute) to be manipulated and clips 5 applied to the ties 29, 33, etc. This gives the workers 3, 4 approximately five seconds per tie to apply clip 5, obtain an additional clip 5, and move ahead to the next tie.

Figure 5:
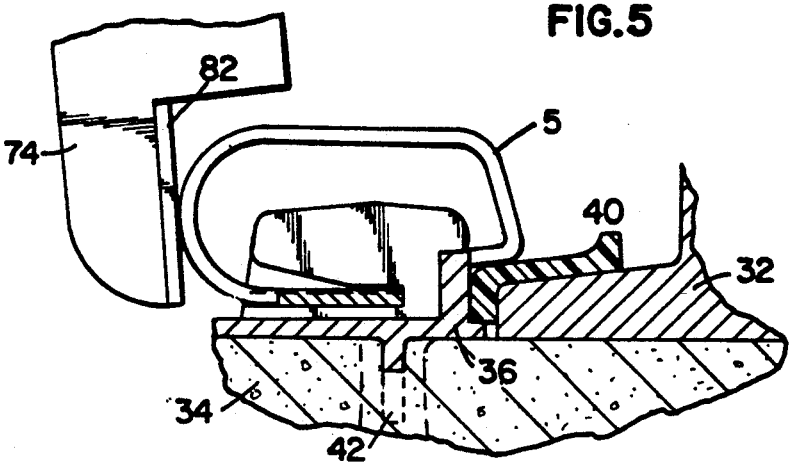
FIG. 5 is an end elevation view showing the relationship of the shoulder, tie, clip and applicator utilized with the present invention.

The track 31 is comprised of rails 32, concrete ties 29, 33, 34, etc. and steel shoulders 36 which are embedded in the concrete tie. As shown in FIG. 5, the insulator 40 is placed between the steel shoulder 36 and the rail 32. A clip 5 is then positioned as shown in FIG. 5 and, after placement and securing steps are performed, fits into the shoulder 36 and over the insulator 40 to secure the rail 32 to the tie. In the preferred embodiment, the shoulder 36 is attached to the concrete tie by integrally formed anchor 42.

Figure 2:
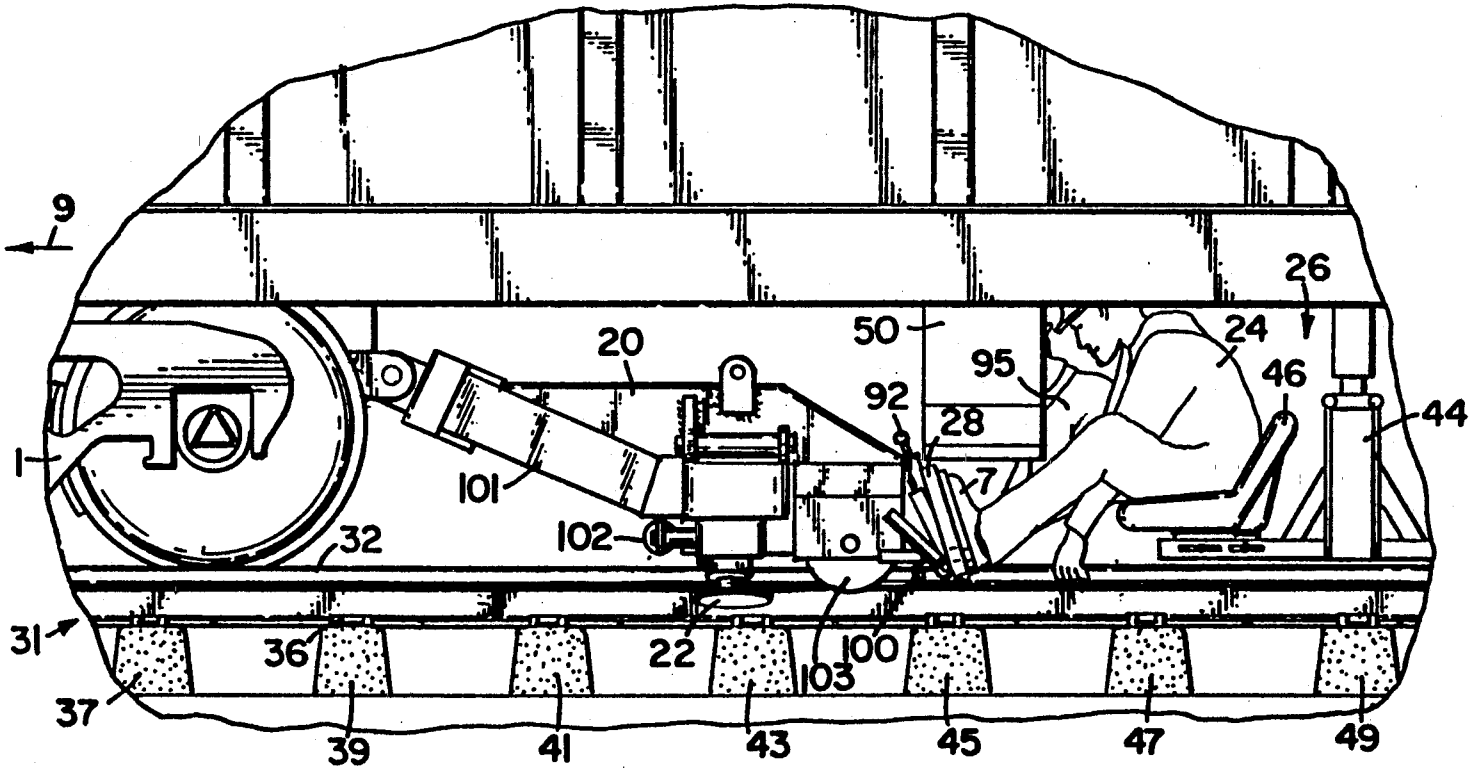
FIG. 2 is a side elevation view of the rail manipulator of the present invention.
Figure 3:
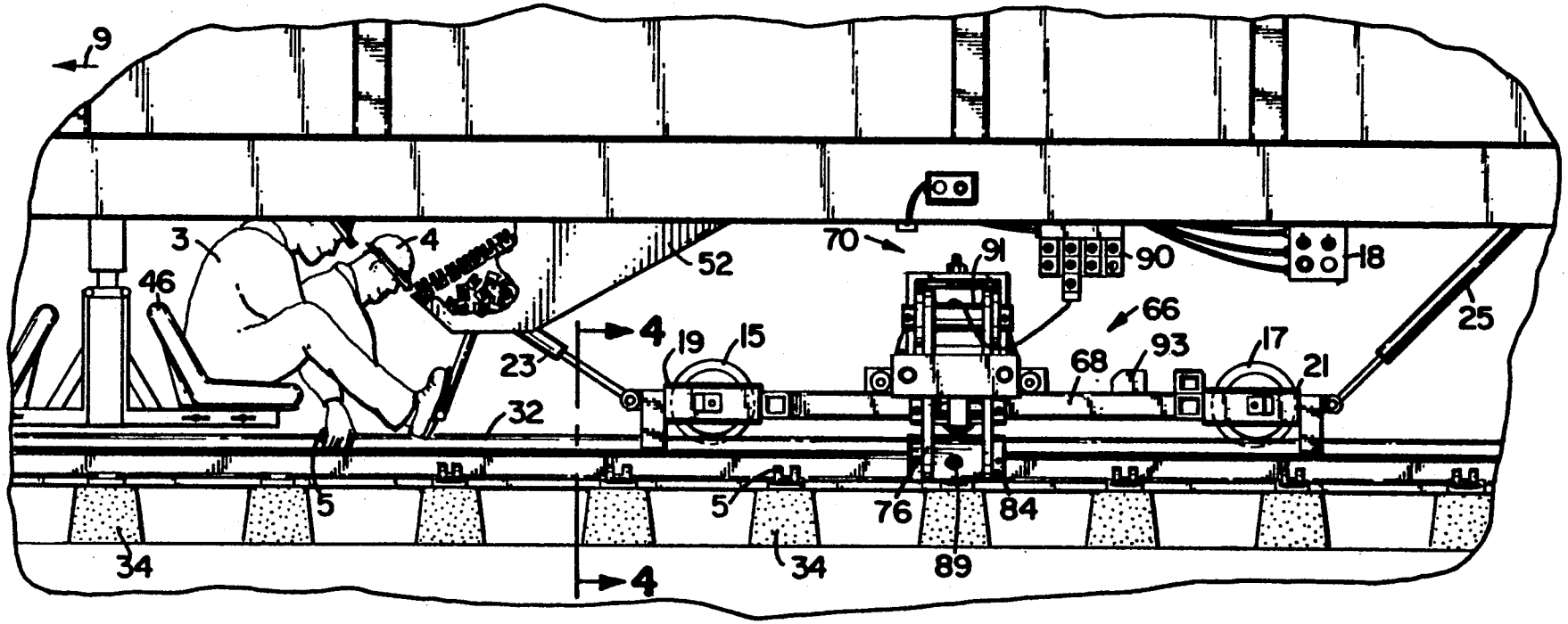
FIG. 3 is a side elevation view showing the applicator and work station of the present invention.
Figure 10:
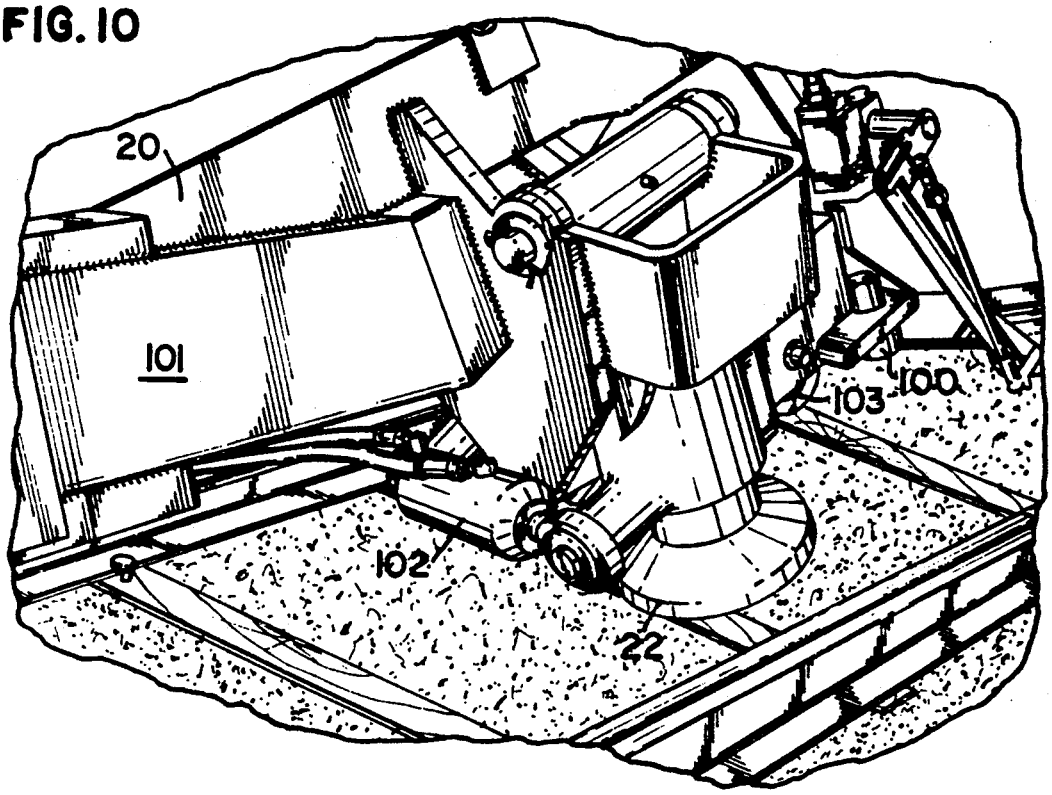
FIG. 10 is a perspective view of a portion of the rail manipulator as depicted in FIGS. 1 and 2.

Referring to FIGS. 1, 2 and 10, the rail manipulator 20 is shown operatively connected to the car 12. In the preferred, embodiment, the rail manipulator 30 is manufactured by Herzog Contracting Corporation, Post Office Box 1089, St. Joseph, Miss. 64502. The rail manipulator 20 includes a main housing 101 and a hydraulic fluid actuated cylinder 102. The manipulator rides along rail 32 and is supported by wheels or rollers 103 which reset directly upon rail 32. As shown in FIG. 2, rollers 22 are utilized an as aligning and shifting mechanism to enable the worker to manipulate the rail 32 laterally up to 3/16 of an inch each way in order to permit placement of the insulator between the shoulder 36 and the tie. Workers 24 and 95 in the work compartment 26 place their feet 7 on the manipulator controls 28 to "align left" or "align right" the rollers 22 and cam followers 100 to align the rail 32 as needed. The rollers 22 engage each rail 32 of the track 31 and workers 24 and 95 control the rollers 22 for each side of the track 31.

The work station 26 includes a frame work 44 which includes four seats 46 for four workers. As mentioned above, the seats 46 are staggered so that the workmen can work without interfering with each other. Proximate the work station 26 and convenient to each worker is an insulator bin 50 and clip bin 52. As shown in FIG. 1, the bins 50 and 52 are connected to larger hoppers 54 and 56 which contain the insulators and clips respectively. A crane 58 is powered and operatively connected to the car 12 so that clips 5 and insulators 40 may be loaded into the bins 54, 56 for use by the workers. In the preferred embodiment, approximately three thousand insulators 40 and approximately three thousand clips 5 may be loaded into the hoppers 54 and 56 for utilization. Further, a deck 60 of the frame work 12 may carry additional boxes and barrels of clips and insulators.

Referring now to FIGS. 1, 3, 4, 6, 7, 8 and 9, the applicator 66 is shown. The applicator 66 includes a frame work 68 which is connected to a pair of satellites 70 and 72. The satellites 70 and 72 are sequenced to automatically stop and apply the clip 5 which has been placed by the worker on each side of the rails 32 of the track 31. The satellites 70 and 72 are controlled independently so that they apply the clips 5 to every rail 32 and tie as the entire apparatus 10 moves down the track 31.

Figure 4:
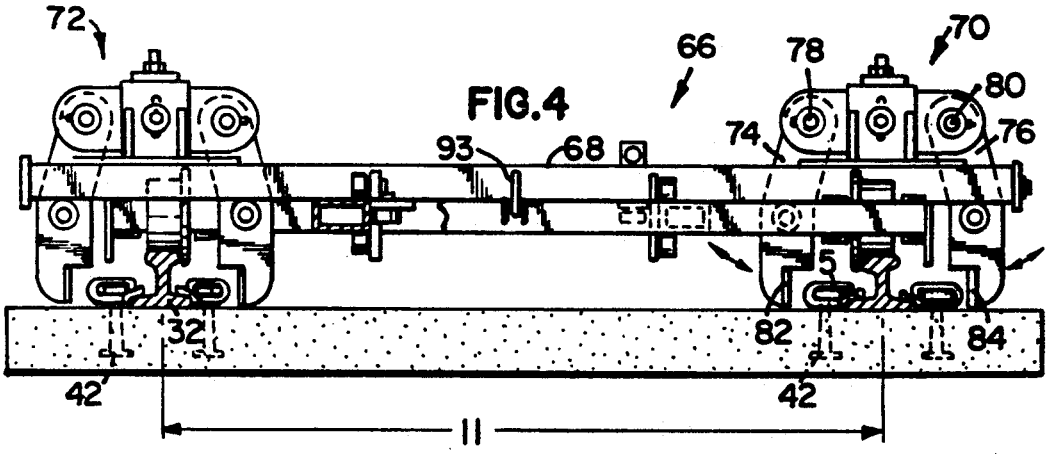
FIG. 4 is an end elevation view of the applicator of the present invention.

Each satellite 70, 72 contains two opposed members 74 and 76 which pivot around shafts 78 and 80. Pads 82 and 84 are connected to members 74 and 76 to contact the clips 5 as shown in FIG. 4. Expansion and contraction of the pads 82 and 84 are controlled by cylinder 85. An electronic signal is sent to cylinder 85 allowing the hydraulic pressure to close pads 82 and 84 in FIGS. 8 and 9. After an electronic variable timer (not shown), nominally set at approximately 1.5 seconds, produces the appropriate signal, the hydraulic controller will reverse the flow in the cylinder 85.

In FIG. 2, a second set of controls 92 are located on the inboard side of the "LEAD" insulator operator 95 which allow one operator or worker to change the travel speed, engine throttle position, control a horn, control the brakes or reset the sensors of the satellites as needed. Worker 95 is able to "lock out" the operation (not shown) in the cab 27 while car 12 is in the work mode. The controls include means for receiving a report regarding the oil pressure, rpm, hydraulic temperature, engine temperature, air pressure, brake condition, etc. of the engine 14 so that the worker knows how the overall apparatus 10 is working.

In operation, the diesel engine drives the power truck 16 and moves the truck 1 in the direction shown by arrow 9 in FIG. 2. The workers 24 and 95 utilize the rail manipulator to place the plastic insulator 40 adjacent the steel shoulder 36 and rail 32. The apparatus is moved forward so that the second set of workers 3, 4 may place the clip 5 on the insulator 40 for application. The satellites 70 and 72 of the applicator 66 then apply force via pads 82 and 84 to move the clip 5 into a secure position onto the shoulder 36, rail 32 and the tie. This operation is continued for the length of the track which is to be secured.

As seen in FIGS. 1, 3, 6 and 7, the applicator structure 66 resides in an area defined by the width 11 of the track 31 and the distance 13 between workers 3, 4 and power truck 16. The distance 13 must be large enough to accommodate applicator 66 plus the distance the car 12 will travel while the applicator 66 is stationary over tie 34 during the clipping or squeezing operation. An additional amount must also be added to distance 13 as a safety factor to ensure that car 12 can be brought to a stop without imposing excessive loads on applicator 66.

The applicator 66 includes a frame 68 which is formed, in a preferred embodiment, as two parallel tubes, each residing above and being substantially coplanar with its respective rail 32. The frame 68 serves as the base upon which satellites 70 and 72 are mounted, as well as a reference plane for an electronic switch (not shown) that is activated by touching each tie. Frame 68 also houses an emergency stop sensor 93, as well as a recovery (or ready) sensor which initiates the restarting of the sequence of applying (or squeezing) the clip 5 into the concrete tie shoulder 36. The frame 68 is secured in a desired position over the rail 32 by use of standard small rail wheels 15 and 17 mounted on axle frames 19 and 21, respectively. Downward pressure is applied to each satellite 70, 72 by means of hydraulic cylinders 23 and 25 in order to ensure that each clip 5 is applied properly and that the satellites 70, 72 do not derail. Cylinders 23 and 25 also lift and retract applicator 66 when the car 12 is in the "travel mode."

Figure 7:
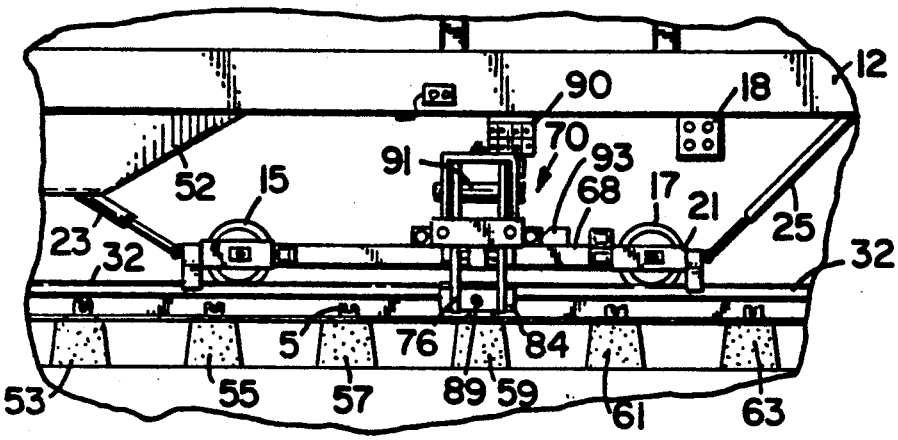
FIG. 7 is a partial side elevation depicting the clip applicator of the present invention in a second operative position.
Figure 6:
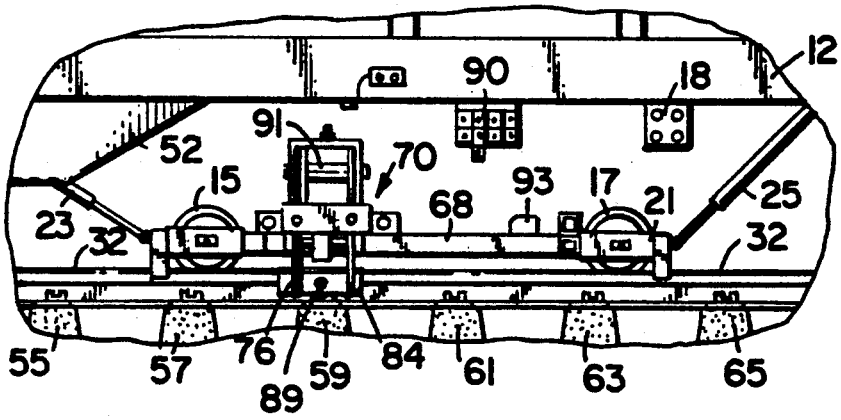
FIG. 6 is a partial side elevation depicting the clip applicator of the present invention in a first operative position.

Referring to FIGS. 4, 6 and 7, the sequence of operation of the satellites 70, 72 after the hydraulic and electrical system (not shown) are energized, is as follows: first, the car 12 moves at a constant speed of approximately 24 feet per minute. The satellite 70, for example, is in a most forward position. That is, the telescoping cylinder 23 is in a relatively compressed position, satellite 70 is over tie 59 and the sensor (not shown) on the satellite 70 senses the presence of tie 59 and engages the hydraulic cylinder 85. This hydraulic cylinder squeezes the two clips 5 into place in the concrete tie shoulder 34. While the satellite 70 itself has stopped over the individual tie 59 the car 12 moves ahead at 24 feet per minute as can be seen by the position of satellite 70 in FIG. 7. When the cylinder 85 has squeezed a constant pressure for a period of nominally 1.5 seconds, it electronically releases and pads 82 and 84 are spread apart due to the action of cylinder 85. This release is based upon time with a constant pressure of approximately 2,000 psi. The damage to the clip 5 from overdriving is prevented by having a manual but adjustable stop 89 to control the cylinder stroke. The release of the clip 5 by satellites 70, 72 (when fully recovered) trips an electrical switch (not shown) that engages a hydraulic cylinder (not shown), which is attached to the frame, to push the applicator 66 back towards the front of car 12. When the satellite 70, 72 is in the front position (or near the front) it can engage on the next tie 57, for example, thereby repeating the operation. Emergency stop 93 signals car 12 to stop, since applicator 66 in that case would not be operating at speed commensurate with the speed of car 12.

Even though numerous characteristics and advantages of the invention have been set forth in the foregoing description, together with details of the structure and function of the invention, the disclosure is illustrative only and changes may be made in detail, especially in the manners of shape, size and arrangement of parts, within the principals of the invention, to the full extent indicated by the broad, general meaning of the appended claims.

We claim:

1. An apparatus for securing rails to ties, comprising:

(a) rail manipulating means for positioning the rail so as to permit placement of clips and insulators on the ties, comprising:

(i) a main housing;

(ii) a pressurized hydraulic fluid actuated cylinder;

(iii) at least one pair of wheels, the pair of wheels being rotatably affixed to the main housing, thereby supporting the main housing on the rails, (iv) a pair of rail translating elements, each rail translating element being pivotably and slidably mounted to the main housing, and being in hydraulic communication with the pressurized hydraulic fluid source, such that the rail translating element will exert a force on the rail independently of any force exerted on an adjacent rail, each gripping element being formed as a substantially circular disc and cam follower, the circular discs being opposably mounted on opposite sides of the rail, each disc being capable of exerting a force against the rail along an axis substantially orthogonal to the rail;

(v) a plurality of control input devices, the control input devices permitting an operator to direct and control manipulation of the rail by the rail translating element, the plurality of control input devices including a pair of foot pedals, the foot pedals being accessible to the operator, the foot pedals directing movement of the rail translating element along an axis transverse to the rail; and (vi) a first and second hydraulic cylinder, the first hydraulic cylinder being pivotably attached to a front region of a frame, the second hydraulic cylinder being pivotably attached to a rear portion of the frame, and both hydraulic cylinders are pivotably attached to a lower surface of a rail car, thereby permitting the frame to be retracted upwardly toward the railcar;

(b) means for securing the clips and insulators to the ties and rails, said means for securing comprising:

(i) the frame, the frame being slidably mounted to the rail; and (ii) a pair of opposable compression members, the pair of opposable compression members being mounted on the frame such that each compression member resides on an opposite sides of the rail, thereby securing an interposed clip to the tie and rail.

2. The apparatus of claim 1, wherein the first hydraulic cylinder and the second hydraulic cylinder are energized so as to exert a downward compressive force on the frame, thereby causing the frame to remain in a relatively fixed horizontal relationship to the rail.

3. The apparatus of claim 2, wherein the frame includes a first sensor, the first sensor determining the presence of a tie, the first sensor thereafter generating a signal so as to energize the compression members, thereby securing the clips residing on the tie to the tie and the rail.

4. The apparatus of claim 3, further comprising a second sensor, the second sensor being affixed to the frame, the second sensor determining a maximum rearward deflection of the frame, the second sensor causing the railcar to cease forward movement when the frame exceeds the maximum rearward deflection.

5. The apparatus of claim 4, wherein the means for securing the clips to the ties further comprises at least a pair of wheels, the pair of wheels being affxied to the frame, the pair of wheels thereby supporting the frame on the rail.

6. The apparatus of claim 5, wherein the frame further comprises a pair of tubes, the tubes being oriented so as to be substantially parallel to the rails, each tube slidably supporting a pair of opposably compression members.

7. A method for distribution and application of rail clips, comprising the steps of:

(a) manipulating a rail for positioning of an insulator on a tie;

(b) positioning an insulator on the rail die so as to support a clip;

(c) positioning a clip on the insulator;

(d) attaching the clip to the tie;

(e) sensing the position of each tie;

(f) activating a device for attaching the clip to the tie in response to sensing the position of each tie;

(g) storing a plurality of insulators on a parent railcar; and (h) seating a person beneath the parent railcar adjacent to the plurality of insulators and adjacent to the rail such that the person has access to the plurality of insulators and can manually position the insulators on the tie as the parent railcar moves along a railroad track.

8. The method of claim 7, further comprising the step of mounting a device for manipulating the rail on the parent railcar adjacent to the person positioning the insulators on the tie, such that the person can manipulate the rail so as to facilitate positioning of the insulator on the tie.

9. The method of claim 8, further including the step of mounting a device to the parent railcar for attaching the clip to the tie.

* * * * *

UNITED STATES PATENT AND TRADEMARK OFFICE

CERTIFICATE OF CORRECTION

PATENT NO. : 5,269,225

DATED : December 14, 1993

INVENTOR(S) : John H. Bosshart et al.

It is certified that error appears in the above-identified patent and that said Letters Patent is hereby corrected as shown below: On the title page:

Item (75), line Inventors, please insert --Mutt Russell, Oliver Springs, Tenn-- after the word "Tenn"

On column 3, line 22, please delete "an as" and substitute therefor --as an--

On column 6, line 8 (claim 1), please delete "sides" and substitute therefor --side--

On column 6, line 42, please delete "die" and substitute therefor --tie--

Signed and Sealed this

Twenty-fourth Day of May, 1994

*Attest:*

Bruce Lehman

BRUCE LEHMAN

*Attesting Officer*

*Commissioner of Patents and Trademarks*